United States Patent [19]

Bianchi

[11] 3,974,786

[45] Aug. 17, 1976

[54] AUTOMATIC SEWING UNIT

[75] Inventor: Nereo Bianchi, Pavia, Italy

[73] Assignee: Necchi S.p.A., Pavia, Italy

[22] Filed: July 26, 1974

[21] Appl. No.: 492,185

[30] Foreign Application Priority Data

July 26, 1973 Italy ..... 42908/73

[52] U.S. Cl. ..... 112/121.12; 112/212

[51] Int. Cl.[2] ..... D05B 19/00

[58] Field of Search ..... 112/121.11, 121.12, 112/121.29, 203, 212, 65, 2

[56] References Cited

UNITED STATES PATENTS

| | | | |
|---|---|---|---|
| 1,929,970 | 10/1933 | Floyd | 112/121.11 |
| 3,178,000 | 4/1965 | Myska | 112/121.11 X |
| 3,332,377 | 7/1967 | Emslie et al. | 112/121.11 |
| 3,360,262 | 12/1967 | Kekopoulos et al. | 112/203 X |
| 3,611,961 | 10/1971 | Lopez et al. | 112/121.11 |
| 3,722,436 | 3/1973 | Strouse | 112/121.11 |

FOREIGN PATENTS OR APPLICATIONS

| | | | |
|---|---|---|---|
| 1,172,430 | 10/1958 | France | 112/203 |

*Primary Examiner*—Werner H. Schroeder
*Assistant Examiner*—Peter Nerbun
*Attorney, Agent, or Firm*—Stevens, Davis, Miller & Mosher

[57] ABSTRACT

An automatic sewing unit formed by a loading station, a mounting table, a transfer mechanism, two preparing stations, two sewing stations and a stacking station for sewn pieces in which the transfer mechanism is made from a mounting member sliding on a guide driven by a pneumatic motor and whereon are positioned a first group of kinematic members and their relative pneumatic actuators to obtain the lifting and lowering movements of a series of pressers provided for the intermittent conveyance of the fabric pieces to be sewn and a second group of kinematic members and their relative pneumatic actuators to vertically draw displacement of the fabric piece from a stack placed in the loading station. Progressive movement of the fabric pieces toward the following stations are made by the displacement of the mounting member along the guide.

9 Claims, 10 Drawing Figures

AUTOMATIC SEWING UNIT

BACKGROUND OF THE INVENTION

The present invention relates to an automatic sewing unit formed by a loading station, a transfer mechanism, two preparing stations, two sewing stations and stacking station for the sewn pieces.

The main object of the present invention is that of making wholly automatic the preparing process of the clothes pieces i.e., shirt cuffs, whereonto different sewing operations are to be executed.

The technical problem to be solved to reach the purpose mentioned above was that of having suitable means to draw the pieces one by one from a stack, bring them under the needle of the sewing units after having suitably oriented and positioned the same and then conveying them toward a stacker. The resolution of the technical problem is characterized in that the transfer mechanism is made by a mounting member sliding on a guide due to the driving of pneumatic motor and whereonto a first group of kinematic members is placed and the relative pneumatic actuators to allow lowering and lifting movements of a series of pressers provided for the intermittent conveyance of the fabric pieces to be sewn and a second group of kinematic members and the relative pneumatic actuators to make vertical displacements for drawing a fabric piece from a stack in the loading station, progress movements of the fabric pieces toward the following stations taking place due to the displacements of the mounting member along said guide.

Further advantages and features of the present invention will appear more in detail by reference to the drawings in which.

Figure 1:
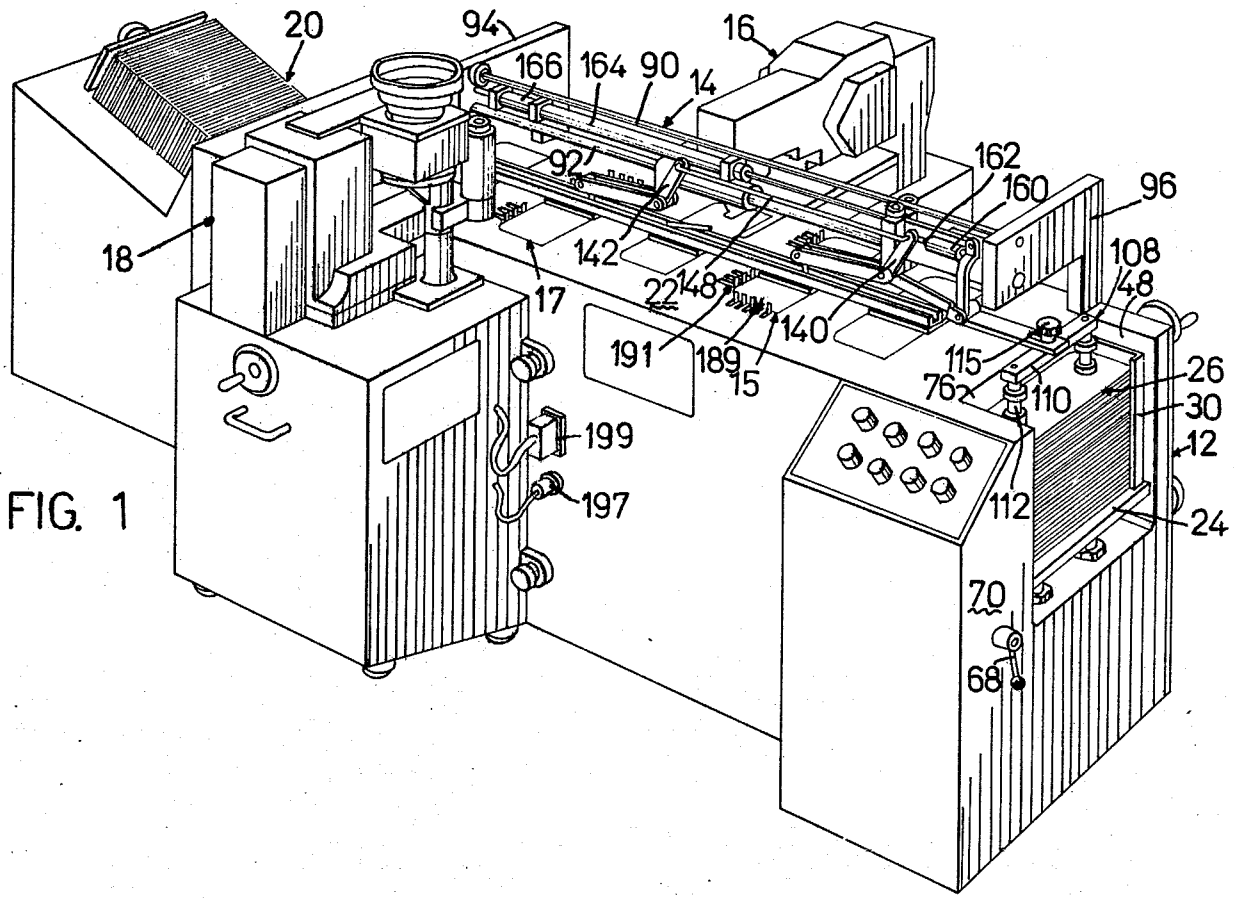
FIG. 1 is a perspective view of the automatic unit.
Figure 11:
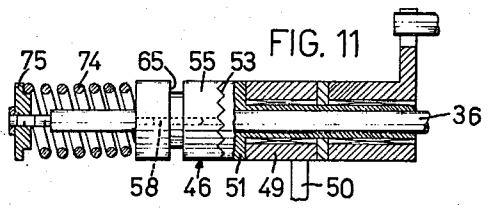
FIG. 11 is a detailed view of a member of FIG. 3.

The automatic unit shown in FIG. 1 is formed by a loading station 12, by a transfer mechanism 14, a first preparing station 15, a first operative station 16, a second preparing station 17, a second operative station 18 and, at last a stacking station 20. Loading station 12 is placed in correspondence with a vertical wall of the mounting table 22 of the automatic unit and is formed by plane 24 supporting cuffs 26, being provided with two bushings 27 (FIG. 3) suitable to displace vertically along two opposite guides 28. This plane 24, having two vertical equal angle walls suitable to contain the stacked cuffs, is fixed through bushings 27 with two driving belts 32, coupling in its lower portion, with two gear wheels 34 fixed on a shaft 36 (FIGS. 2 and 3), idly mounted on a bushing 38, at one end and carried at the other end by a bushing 40, carrying a free wheel mechanism 46, hereinafter described in detail. The shaft 36 receives, through said free wheel mechanism, an intermittent rotary motion. Driving belts 32 couple, in the upper portion of the loading station, with two other gear belts 44 idly mounted on pins 45 rigid to mountings fixed to guides 28 and to side wall 48 FIG. 1 of table 22. Free wheel mechanism 46 (FIG. 11), suitably imparts an intermittent rotary motion to shaft 36 and consequently a jerk elevation motion to mounting plane 24 through the system formed by gear wheels 34-chains 32. The free wheel mechanism is formed by a first bushing 49, provided with a free wheel device, idly mounted on shaft 36 and projecting into a rod 50 hinged to another rod 52 fixed to rod 54 of cylinder 42. First bushing 49 transmits motion received from cylinder 42 to a second bushing 51 idly mounted onto shaft 36, having at one end a gearing 53 coupling with third bushing 55 coupled with shaft 36 through a key system 58 restraining said bushing 55 to shaft 36 in its rotary motion and leaving this member free to make small relative axial displacements. A block 60 oscillating around pin 62 fixed to mounting table 22 has a tooth 63 suitable to penetrate in a circumferential groove 65 of bushing 55. Oscillations can be transmitted to said block 60 through the end of rod 64 of pneumatic cylinder 66 and also manually through a lever 68 (FIG. 1), shown on vertical wall 70 of the loading station 12, fixed to block 60 through rod 72. When block 60 is actuated its tooth pushes bushing 55 axially to the left (FIG. 11) thus disengaging shaft 36 from free wheel bushing 49. By this way the cuffs' mounting plane 24 can slide unlimitedly downwards by the action of its own weight and that of the cuff stack placed on it. Spring 74 (FIG. 11) wound up around the end of shaft 36 between ring 75 and bushing 55 has the function of keeping bushings 51 and 55 always coupled, when block 60 is not actuated.

Figure 2:
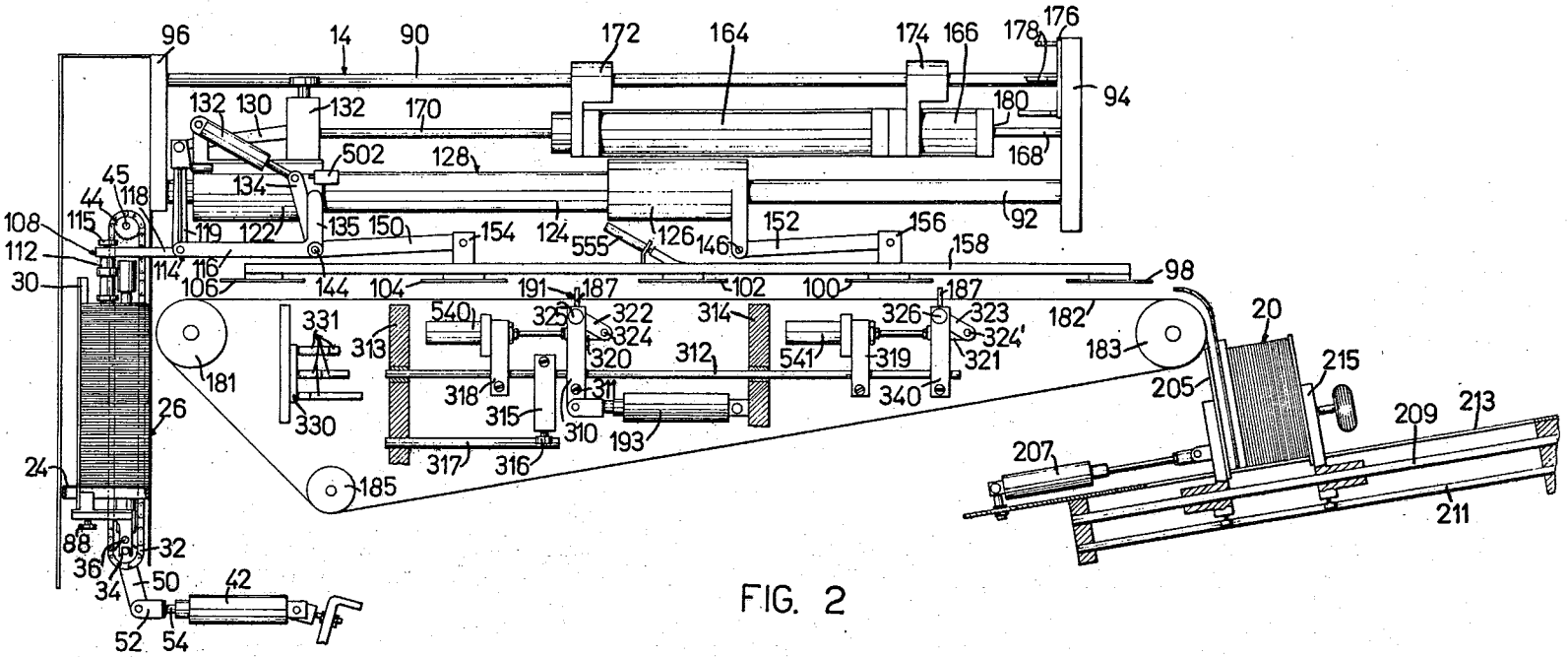
FIG. 2 is a schematic view of the driving members of the cuffs conveyance and registration.
Figure 3:
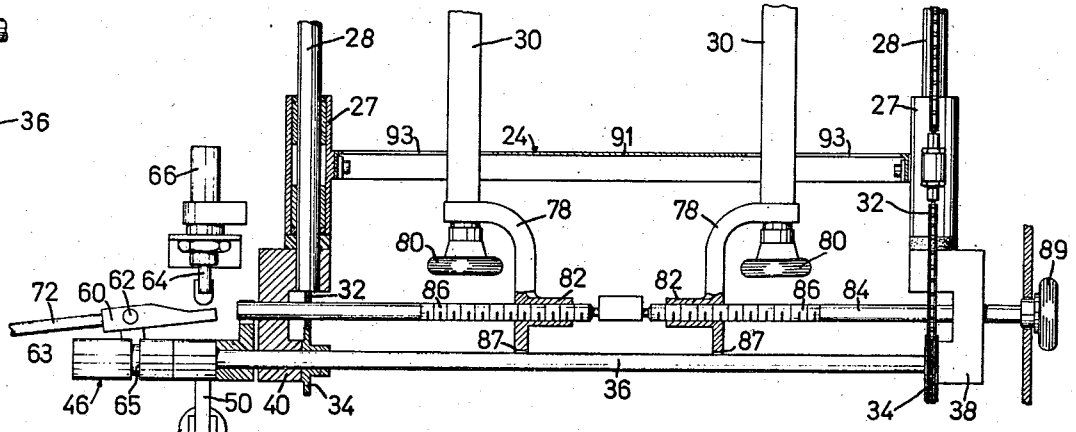
FIG. 3 is a detailed view of the loading station.
Figure 10:
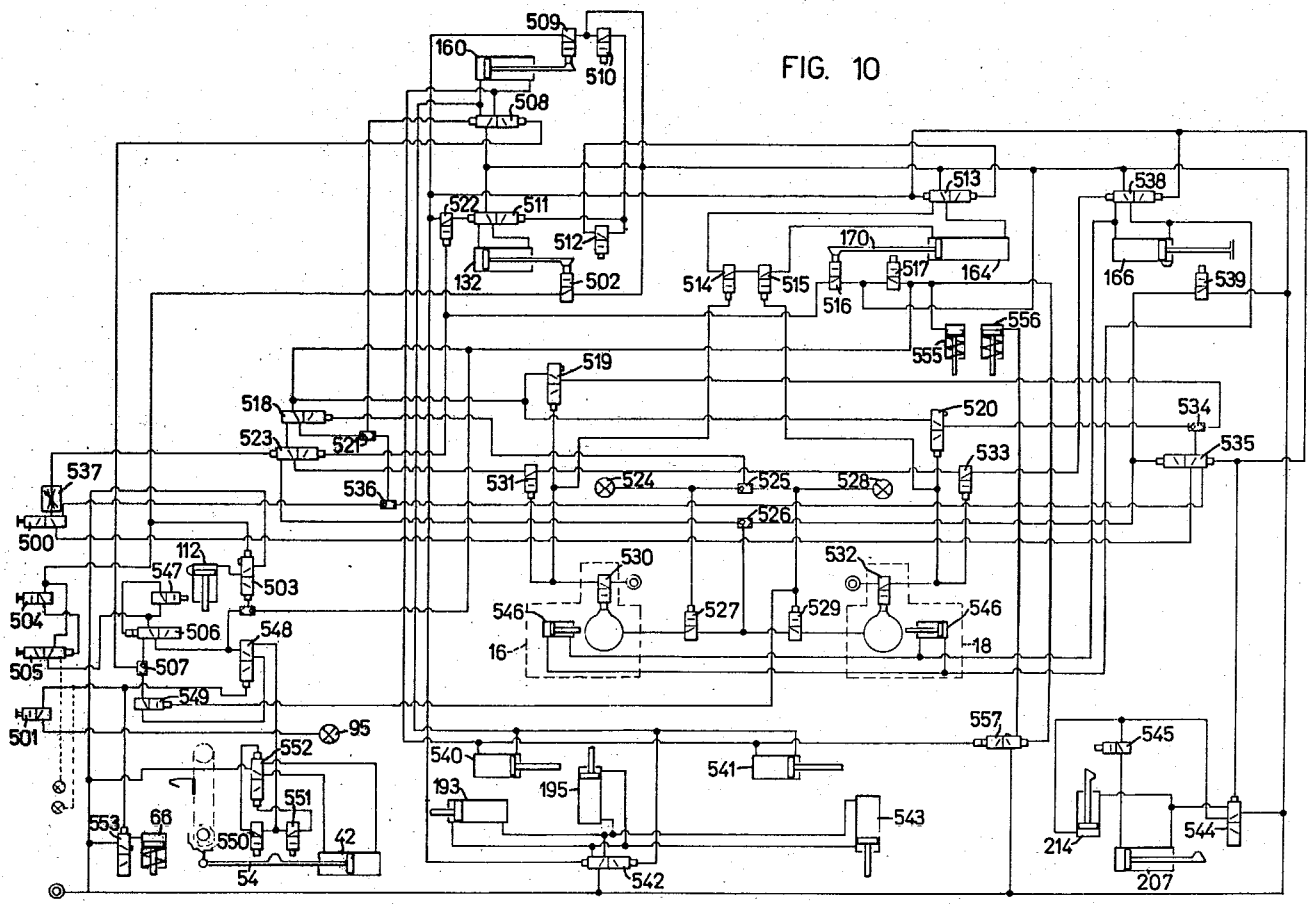
FIG. 10 shows the pneumatic layout of the automatic unit.

Two adjustments are provided for the vertical angle walls 30 containing the cuffs' stack. Said adjustments are necessary to adapt walls 30 to the variable cuff length and width. For this purpose, vertical angle walls 30 forming together with side wall 76 of mounting 22, the cuffs' container, are mounted on two brackets 78 (FIG. 3) through two knobs 80 having a threaded stem screwing into threaded holes made out in the lower portion of said angle walls 30. Said brackets 78 have two bushings 82 also threaded, ending in their lower portion with two semicylindrical guides 87 surrounding shaft 36. Bushings 82 are mounted on circular bars 84 parallel to shaft 36 having two opposed threads 86. By turning knob 89 fixed at the end of a bar 84 two brackets 78 separate or approach each other for the same amount thus providing angle walls 30 to receive cuffs of different lengths. In order to adjust angle walls 30 to contain cuffs of different widths, two guides placed in the cuffs width direction are provided in the upper portion of brackets 78. Unscrewing knobs 80 angle walls 30 are caused to slide along said guides, having a slot all along their stroke, toward wall 76 or away from it. Then knobs 80 are rescrewed in the desired position, locking brackets against walls of said guides. To allow adjusting movements of the two vertical angle walls 30, plane 24 carrying cuffs' stack 26 (FIG. 1), has a central solid portion 91 and two side discharge portions 93, as shown in FIG. 3. A pneumatic eye 95 (FIG. 10) is provided in the central solid portion 91 of said plane 24. Said eye 95 has the task of revealing the cuffs' presence and of actuating the return drive for said plane 24 to said loading position, when the cuffs are exhausted. This drive is sent to pneumatic cylinder 42 actuating the release of shaft 36 from the free wheel system 46 and plane 24, owing to the gravity law can come back to its lowest position. Transfer mechanism 14 is supported on mounting table 22 by two parallel and overlapped horizontal guides 90 and 92 fixed at their ends to two brackets 94 and 96 rising over said table. The device is formed by a set of pressers 98, 100, 102, 104 and 106 (FIG. 2) that can slide in the guides direction or make vertical displacements downwardly or upwardly, thus making rectangular paths needed to convey the fabric pieces in a direction with intermittent movement. Besides said pressers, an assembly 108 is provided in the transfer mechanism and is suitable to draw cuffs from cuffs stack 26 placed on the loader and to carry them under the first presser 106.

Before disclosing the transfer mechanism in detail it is necessary to specify the movements which are to be imparted to the cuffs and the sewing operations to be executed on them.

A cuff from stack 26 drawn by assembly 108 hereinafter called pick-up, is raised to a level a little higher than the work plane of mounting table 22 and carried horizontally for a certain distance in the direction of guides 90 and 92 towards sewing stations 16 and 18. Now the cuff is caused to fall on the work plane and the pick-up comes back to the stack to draw another cuff.

The first cuff is carried forward, during a following operation by presser 106 to a preparing station 15 wherein it is properly positioned and then displaced during a further cycle by presser 104 under the first sewing station 16 formed by a buttonhole sewing machine.

Figure 8:
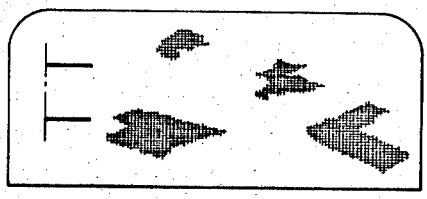
FIG. 8 shows a cuff with two aligned buttonholes.

Supposing one has to execute two buttonholes on the same cuff (FIG. 8), after the sewing of the first buttonhole, the cuff is displaced by presser 104 again for the prescribed distance provided between the two buttonholes. Then the second buttonhole is sewn. The cuff is now drawn by presser 102 and carried to the second preparing station 17 and then drawn by pad 100, under the sewing station 18 where, like for the first one, two buttons are sewn on the cuff at the same prescribed distance as the buttonholes.

Finally, the cuff is drawn by presser 98 and carried toward the loading station 20. All the operations made on the first cuff are repeated on the following cuffs drawn by the pick-up from stack 26 and carried onto the work plane 22. Pick-up 108 is formed by a rod 110 and at its ends has two cylinders 112 turned downwardly. According to a known embodiment, the piston rod of said cylinders is formed by three points enlarging when the cylinders are actuated. The points close and fix the cuff thereon, when feeding runs out to said cylinders. Rod 110 is locked to a two-armed lever 114 in a position adjustable through knob 115 with threaded stem passing through a slot made out on the first arm 118. The lever 114 is pivoted, free to rotate, at the end of rod 116. Second arm 119 is arc-shaped and lower guide 92 is placed therein. Rod 116 is pivoted at its other end to an extension 135 of a sleeve 122 that together with a central bushing 124 and another sleeve 126 makes a mounting member 128 sliding along guide 92.

At the upper end of second arm 119 of lever 114, over guide 92, another rod 130 is pivoted. Rod 130 at its opposed end is pivoted free to rotate onto a block 132 machined from the upper portion of sleeve 122. Two-armed levers 114, lower rod 116, upper rod 130 form the elements of an articulated quadrilateral the fourth side of which is formed by mounting member 128 sliding onto guide 92. Movement control of the articulate quadrilateral is carried out by a pneumatic cylinder 132 pivoted at one end to sleeve 122 being a part of mounting member 128. The rod of cylinder 132 is connected to the upper portion of a lever 134, which in turn is connected to an extension 135 of rod 116. When cylinder 132 is actuated, lever 134 oscillates causing rod 116 to make a rotation transmitted to rod 110 and cylinders 112 making a vertical stroke upward. The fact that the movements are vertical is due to the kinematic properties of the articulated quadrilateral.

Downward strokes of pick-up 108 take place by gravity at the end of the actuation of cylinder 132.

Pressers 98, 100, 102, 104 and 106 and kinematic members are fixed to mounting member 128, coupled to guide 92, to derive their vertical movements. Said kinematic members are formed by levers 140 and 142 (FIG. 1) fixed forward to their respective pins 144 and 146 mounted freely to rotate into suitable seats made out in the lower portion of sleeves 122 and 126 and connected upwardly to each other through pivot points by a tie rod 148.

Two rods 150 and 152 are fixed to said pins (FIG. 2) and are connected to a channel bar 158 and presser 98, 100, 104 are elastically connected to the lower portion of channel bar 158.

Figure 7:
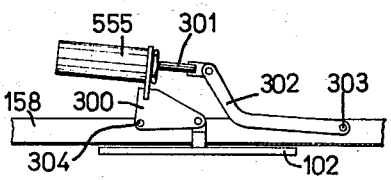
FIG. 7 is a detailed view of a transfer device member.

A further presser 102 also is connected to channel 158 but in a different way relative to the other pressers. In fact, presser 102 is connected to a plate 300 (FIG. 7) through a pivot point, plate 300 being in turn pivoted at 304 to channel bar 158. Plate 300 is fixed to a cylinder 555 and rod 301 thereof is connected through a pivot point to a lever 302 pivoted in turn at its other end at 303 to channel bar 158.

Actuation of cylinder 555 causes lever 302 to oscillate around pin 303 and the oscillation forces cylinder 555 and plate 300 to rotate around pin 304. Following this, rotation presser 102 makes oscillations upward and downward relative to channel bar 158. The explanation of this liberty of movement of presser 102 relative to channel bar 158 will be given during the following description of the whole working assembly.

Fixed to sleeve 122 in the same way as cylinder 132 is a second cylinder 160, rod 162 thereof being connected through a pivot point to the upper end of lever 140. Through the kinematic motion described above, the displacement of rod 162 of cylinder 160 creates nearly vertical oscillations of the pressers. Horizontal movements of the pressers and of the pick-up assembly 108, whether they be transfers between the stations or smaller movements for the sewing of two buttonholes and two buttons on the same cuff, are made through the assembly formed by cylinders 164 and 166 in the way described hereinafter.

Rod 168 of cylinder 166 is fixed to bracket 94 and cylinder 164, strictly connected to cylinder 166, has its piston rod 170 fixed with its free end to block 132 of sleeve 122 of mounting member 128.

Cylinder 164 also is coupled through its bushings 172 and 174 to guide 90.

Every time that cylinder 164 is actuated, its piston rod 170 drags mounting member 128 in its alternate displacements and consequently, pick-up 108 and pressers supported by mounting member 128.

During these displacements, the assembly of cylinder 164 and 166 remain still.

However, when cylinder 166 is actuated, to make little displacements relative to the distance between two buttonholes and two buttons of the same cuff, with piston rod 168 being fixed to bracket 94 of mounting 22, the assembly of cylinders 164 and 166 is forced to move thus dragging into motion mounting member 128, through rod 170, and consequently pressers and pick-up 108.

In order to make little transfer displacements of different adjustable lengths, there is a rotating drum 176, fixed to bracket 94, near piston rod 168, and carrying retainers 178 formed by bars of different length onto said drum and rotatable with it.

Wall 180 of cylinder 166 stops, against one of said retainers chosen by turns according to the distance desired between buttonholes and buttons of cuffs. A belt 182 of a high friction coefficient material is suitably provided to cooperate with pressers for the cuffs conveyance. The belt runs under pressers onto the work plane for all of its length while winding around three idle pulleys 181, 183, 185 placed onto mounting 22.

Position registers formed by rows of pins 191 (FIG. 2) are provided to cooperate with pressers for the progress of the pieces to be sewn. Pins 191 project from mounting table 22. They are placed in correspondence with every preparing station preceding the relative sewing station and are used for rightly positioning the workpiece before arriving under the needle of the sewing unit.

Figure 6:
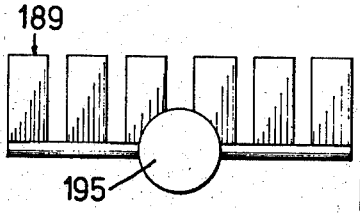
FIG. 6 is a detailed view of transverse registers.

Every register is formed by two pin rows placed perpendicularly one relative to the other(FIG. 1). The first pin row 189 displaces transversely relative to the table. On the contrary, the second pin row 191 displaces longitudinally relative to the table and pins 187 composing said second pin row 191 also having a lowering movement necessary to avoid interference with the progress motion of the workpieces. With reference to FIGS. 1, 2 and 6, transverse pin row 189 is integral with the piston rod of cylinder 195 and is displaceable through the actuation of such cylinder 195 in a transverse direction relative to the transfer direction in order to have the sewings made on the cuff at a prearranged distance from the edge of the cuff.

Pin row 191 registering the cuff position in the conveyance direction, are displaceable in such direction by means of a pneumatic cylinder 193. A block 310 integral with shaft 312, through a screw 311, is fixed to cylinder 193. Block 310 is placed on two fixed mounting 313 and 314 and carries at one free end a block 340 whereon the second pin row 191 is placed. Also a second block 315 is fixed to shaft 312 by means of roller 316 coupled to shaft 317 fixed to mounting 313 in order to avoid the rotation of shaft 312 around its own axis.

Mountings 318 and 319 also are fixed to shaft 312, carrying cylinders 540 and 541 respectively which are jointed to pins 325 and 326 supporting pins 187 by means of a crank mechanism of rods 320, 321 pivoted at 324 and 324' to levers 322, 323 respectively When cylinders 540 and 541 are actuated, through the kinematic chain described above, pins 187 rotate and can be turned over under the work plane 22. An axial stroke of shaft 312 controlled by pneumatic cylinder 193, is adjustable by a drum assembly 330 carrying pins 331 of various lengths which can be selected thus adjusting the distance of the buttonhole from the edge of the larger side of the cuff.

The drive of the registers is effected by suitable pneumatic cylinders 193 and 195 (FIG. 10) inserted in the pneumatic circuit actuating the whole automatic unit which will be subsequently described in more detail.

The operating stations are formed by automatic sewing machines for sewing stitch groups and more precisely by a buttonhole sewing machine and by a button sewing machine. The button sewing machine is mounted on its own mounting providing movable air intake 197 and socket 199 to connect the sewing machine to the connections provided on the mounting front portion.

By this way, the interchangeability of the sewing machine is assured. The second sewing machine, the buttonhole sewing machine, connecting to the unit by the same way, is provided on the opposite side of the mounting. Buttonhole and button sewing machines are placed onto their own tables in such a way that they can be adjustably displaced in order to vary the buttonhole or button position relative to the cuff edge.

Figure 4:
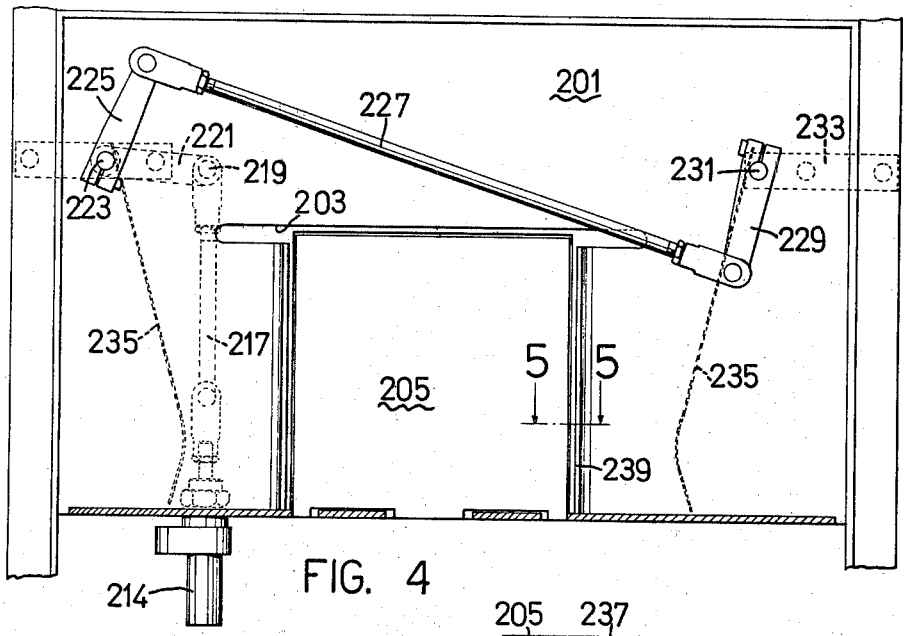
FIG. 4 is a detailed view of the stacking station.
Figure 5:
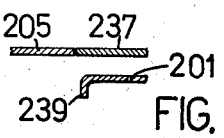
FIG. 5 is a sectional view taken along line 5—5 of FIG. 4.

At the end of the last sewing operation, the cuff is conveyed by presser 98 and by the underrunning belt toward a chute formed by an extension of the work plane 22 through a portion of curved surface which slants relative to the vertical. The cuff falls along said surface into a closed container made by said extension and by a plate 201 placed thereon at a little distance there from. Such plate and such extension surface have a rectangular central opening 203 (FIGS. 2, 4 and 5) of the same width wherein a plate 205 slides, fixed to the rod of cylinder 207 placed into mounting 22.

Two circular section guide rods 209 and 211 are provided, overlapped and placed under a plane 213 slightly inclined and fixed to the apparatus wall. A second rectangular plate 215 slides along the guides, having its extended side longer than the openings on the plate and on the extension surface. When the cuff falls into the bottom of the space formed between plate 201 and the extension surface, it is trued by the device shown in FIG. 4.

The device comprises a pneumatic cylinder 214, fixed to inclined plane 213 of the stacker behind the two plates. The piston rod of pneumatic cylinder 214 is pivotably fixed to a rod 217 which in turn, is fixed to a pin 219 idly carried by a fork-shaped member 221. A pin 223 integral with the fork-shaped member 221 and fixed to lever 225 projects from plate 201. Lever 225 is pivotally attached at one end of a rod 227 which rod 227 at its other end is pivotally attached to a second lever 229 which in turn is fixed on pin 231. Pin 223 like pine 231 passes through plate 201 and is idly mounted on member 233. On actuation of cylinder 214, through kinematic chain described above, oscillations of the two pins 223 and 231 are obtained in mutually opposite directions and consequently oscillations of elastic plates 235 mutually approach and separate. These movements are necessary for the correct positioning of the cuff that has to be stacked. Between the two plates, elastic plates 235 are fixed to pins 223 and 231; such plates 235 reach nearly to the bottom of the space formed by inclined plane 213 and plate 201 and the extension surface 237.

When the cuff is properly positioned in the space cylinder 207 is energized and its piston rod moves and brings a plate 205 fixed at its end into contact with the cuff and continuing its stroke, pushes such cuff against the other cuffs already stacked, held at one end by the edges 239 of plate 201 and at the other by plate 215.

Now the cuffs stacked and clamped between plates 205 and 215 displace along inclined plane 213.

When the piston rod of cylinder 207 reverses itself plate 215 by gravity, pushes the cuffs' stack into the beginning position wherein the cuffs are kept stacked by the action of plate 215 and the edges 239 of plate 201. With reference to the pneumatic layout of FIG. 10, suppose switch 501 is in the "on" position and provides automatic connect and disconnect feeding to the cuff loader and the cuffs are stacked at the correct height to allow normal working of the pick-up.

Cylinders 112 of the pick-up press over the first cuff and cylinder 132 driving pick-up lifting is actuated and accordingly, the same pick-up is lowered.

Valve 502 is open and the air flow passing through the pilot of valve 503 reaches cylinders 112 which opens thus preparing to clamp the fabric.

Now, the operator pushes the start button 504 for the beginning of the automatic cycle. Air flow through start button 504 pilots stop valve 505 and through such valve, valve 506 and switch 507 pilots valve 508, thus switching to extend piston rod of cylinder 160 driving sliding pressers upwardly. The piston rod closes valve 509 and at the end of its stroke opens valve 510 consequently piloting valve 511 actuating cylinder 132, the rod thereof extending thus closing valve 502 stopping feeding to cylinders 112 of the pick-up so that the clamps close, thus clamping the fabric. As the two valves 514 and 515 are open because the two sewing heads are at a standstill, at the end of its stroke the piston rod opens valve 512 and air flow pilots valve 513 and cylinder 164 is fed in order to have the piston rod retracted.

Piston rod 170 at the beginning of its stroke, closes valve 516 and at the end opens valve 517 so that piloting is inverted to valve 503 and feeding to cylinders 112 is curtailed; clamps open, thus letting fabric fall to the work table. At the same time, air flow reaches valve 518 and the two valves in parallel, 519 and 520.

If the sewing machines are at a standstill, the two valves 519 and 520 are closed.

Until a cuff is in the first sewing station, the operating cycle goes on as follows.

Air flow, from valve 518, controlled by its own spring, passes through switch 521 and pilots valve 508. Consequently, the piston rod of cylinder 160 is retracted and pressers rise. Valve 510 closes and valve 509 opens thus switching valve 513 and rod 170 of cylinder 164 is extended to make its return stroke with the pressers raised. During its stroke, it closes valve 517 and opens valve 516 piloting valve 522 therethrough. Air flow pilots valve 511 which causes retraction of the piston rod of cylinder 132 and then pick-up lowering. At the same time, opening of valve 516 pilots valve 523.

Retraction of the piston rod of cylinder 132 driving the pick-up lifting opens again valve 506 switching valve 503 and through stop valve 505, switch 507 pilots valve 508 in such a way as to repeat the operating cycle already described. Cuffs are more and more transferred to the following stations. When the first cuff comes under the head of the first sewing unit 16, the corresponding pneumatic eye 524, through switch 525, pilots valve 518 so that the opening of valve 517 which occurs at the end of the stroke of cylinder 164 causes air flow to pass through valve 523, instead of from switch 521, toward switch 526, and carrying stroke which drives pressers as long as the sewing units have carried out first sewing unit beginning its automatic sewing cycle.

The second sewing unit 18 remains at a standstill until its pneumatic eye 528 reveals fabric presence which then opens valve 529. During the operating cycle valve 530 closes and air flow to valves 514, 519 and 531 is curtailed. Likewise, when the second sewing unit 18 is carrying out its operating cycle, the opening of valve 532 will break off the feeding to valves 515, 520 and 533.

The closing of valves 514 and 515 described above, assures exclusion of the actuation of cylinder 164 carrying stroke as long as the sewing units have carried out their operating cycle.

To the contrary, opening of valves 519 and 520, assures arrival of air flow to switch 534 and then to valve 535, about the time when one of the sewing units has begun its operating cycle.

From valve 535, air flow reaches valve 500 selecting the sewing member. If this valve is changed over to execute one sewing only, that is, only one buttonhole and only one button per cuff, air flow reaches switch 536 and therefrom to switch 521 and the unit operating cycle repeats itself for sewing the following cuffs.

If valve 500 selecting the sewings number is changed over to execute two sewings on the same cuff, air flow through regulator 537 reaches valve 523, so that, at the end of the first sewing, when the two sewing units stop and valves 531 and 533 are open again, air flows reaches valve 530 opening and consequently actuating cylinder 166 which, as described before, makes a stroke thus dragging pressers still lowered for the distance between the two sewings as long as said cylinder 166 opens valve 539 at the end of its stroke. Air flow, through said valve 539, reaches again switch 526 and then, in the presence of the cuffs to be worked, the sewing units 16 and 18 make the second operating cycle.

For valve 539, air flow pilots valve 535 so that air flow from switch 534 instead of flowing toward valve 500 is sent to switch 536 to re-establish the conditions for a new operating cycle of the automatic unit.

Particularly when, the piston rod of cylinder 160 is retracted for the raising of pressers valve 509 opens and pilots the action of valves 513 and 538 in such a way as to cause cylinders 164 and 166 driving sliding pressers carrying stroke to come back to the starting cycle conditions.

Cuff positioning registers of the preparing stations 15 and 17 preceding the operating ones, are actuated relative to the pressers raising movements because they must work when pressers are raised and have released cuffs.

When, during the operating cycle, pressers lowering is requested and valve 508 is changed over air flow consequently reaches also cylinders 195 and 543 driving registers through transverse reached also cylinders 195 and 543 driving registers transverse movements.

The processing procedure referred to hereinbefore now takes place in the way described hereinafter.

Referring to FIGS. 1 and 2, cylinders 122 press downwardly on the first cuff and pressers 106, 104, 102, 100, 98 are raised in their position at the beginning of the feeding stroke.

Cylinder 132 causes the raising of cylinders 112 which lift the cuff.

Cylinder 160 is actuated to lower the pressers and then cylinder 164 is actuated to cause pressers and cylinders 112 to make the forward stroke.

At the end of this stroke, the cuff just drawn from the stack is abandoned by cylinders 112 on table 22 in such a position as to be drawn by presser 106 when it has come back to the start position shown in FIGS. 1 and 2.

During the following pressers feed stroke, the cuff is pushed by presser 106 under the first registering station. Pin rows 189 and 191 of this first registering station operate the right cuff alignment during the pressers return to their start position.

After being registered the cuff is carried, by presser 104 lowered thereon, under the first sewing station. Simultaneously presser 106 will have pushed a new cuff under the first registering station.

Pin rows 189 and 191 of the corresponding longitudinal and transverse registers act, during their relative strokes on the cuff edges to obtain the right positioning at the end of the strokes.

It is to be noted that, when two sewings cuffs are desired, such cuffs reach the first sewing station in a certain position, controlled in the first registering station and are liable to a displacement toward a second position equal to the step between the two sewings. Presser 102 for the cuffs displacement from the first sewing station to the second register station, draws cuffs from such a second position and displaces them for a distance equal to the length of the stroke of cylinder 164. Successively, the presser makes another displacement corresponding to the step between the two sewings. If the presser rises only now to release the cuff and allow the registering operation, the longitudinal register causes the same cuff to withdraw for at least a distance equal to twice the step between the two sewings.

On the contrary, if such a pad should rise to release the cuff at the end of the first displacement corresponding to the stroke of cylinder 164, in the following registering operation, the longitudinal register would cause the cuff to withdraw only for a distance corresponding to the step between the sewings. A sewing table should result by this way which is more compact and a greater rationality in the pneumatic controls should be reached. In order to obtain this, a cylinder 555 has been provided that, against its own spring, raises such pressers 102 when piston rod 170 of cylinder 164 has just opened valve 517. At the same time, opening of valve 517 pilots valve 557 so that air flow reaches a further cylinder 556, the piston rod thereof carrying a little presser which lowers onto the cuff and prevents it from displacing owing to the dragging of belt 182. Presser 102 has been connected for this purpose to channel bar 158 in the manner described above. Valve 557 is piloted in an opposite way thus raising the presser integral with the piston rod of cylinder 556, in the movement in which air flow pilots valve 508 driving retraction of cylinder 160 for the actuation of cylinders 540 and 541 and for the raising of longitudinal registers 187 from the underside of the table 22.

Stacking station 20 must be driven after the carrying stroke of the pressers which has let a new cuff fall into the space between the two plates 201 and 237.

According to the layout, this driving takes place when opening valve 509 by the piston of cylinder 160 for the pressers lifting switches, as already described, valves 513 and 538.

Together with such valves, it switches in fact, valve 544 so that air flow reaches cylinder 214 for the cuff settlement between plates 201 and 237 and when the piston rod of cylinder 214 has opened at the end of stroke, i.e., valve 545, air flow reaches stacker driving cylinder too.

When cylinder 160 driving pressers which are being lifted is actuated to control the pressers being lowered and its piston rod leaves valve 509 thus closing piloting of valve 544, and two cylinders 214 and 207 come to their position of rest. Thanks to this interdependence between cylinder 160 for lifting the pressers and stacker cylinder 207 at the end of the sewing cycle, the pressers remain lowered. The stacker stops with the cuffs stacked at the end of plate 213 thus making easier the cuff discharging operation. Double-acting cylinders 546 driving the sewing units transverse movement are fed in parallel with double-acting cylinder 166 driving the cuffs' little displacements.

Figure 9:
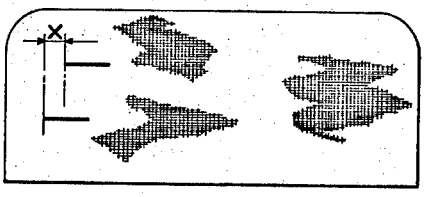
FIG. 9 shows a cuff with two non-aligned buttonholes.

These cylinders 546 are connected to slides onto which the two sewing machines are mounted and are actuated, during the automatic cycle, when it is necessary to carry out the sewings positioned in a particular way (FIG. 9), i.e. when the first button or buttonhole has been sewn and before beginning the sewing of the second button or buttonhole which is not aligned with the first ones in the conveyance direction but displaced toward the inside of the cuff. As transverse displacement of the cuff cannot take place, the sewing units displace automatically transversely relative to the cuff transport direction.

Pick-up 108 lowers during the automatic cycle in order to draw a new cuff and bring it onto the work plane. Plane 24 carrying a stack of cuffs 26 maintains itself at a standstill as long as the pick-up, drawing following cuffs, maintains its oscillation within a determined value. Consequently, when the stack of cuffs 26 is lowered, pick-up 108 in its oscillation, pilots valve 547 which in turn pilots valve 506, thus sending air flow to pilot valve 503 to break off the feeding to cylinders 112 and at the same time, to valve 548, instead of piloting valve 508 through switch 507. Under normal conditions, air flow from valve 548 reaches valve 549 which is open only when pneumatic eye 528 of the second sewing unit reveals the presence of fabric. In this case, air flow can still flow through valve 549 toward switch 507 to begin the cycle again.

If pneumatic eye 95 of the stacker still reveals cuff presence on plane 24, and if valve 547 excluding stacker driving, is open, valve 548 is piloted so that air flow can reach valves 550 and 551 in parallel one relative to the other with each of them piloting valve 552.

These valves 550 and 551 are switched by the end of the stroke of piston rod 54 of cylinder 42 of the stacker and act on valve 552 to control driving of cylinder 42 and then lifting stack 26 as far as pick-up 108 releases piloting of valve 547. Thus, the normal cycle is re-established. Pneumatic eye 95 of the stacker in the fabric presence, besides piloting valve 548, for the functions described above, pilots also valve 553 so as to make ineffective cylinder 66 disconnecting the loader.

When cuffs on the loader are exhausted, the loader disconnection takes place and, as valve 548 is not yet piloted by the same pneumatic eye 95, the sewing unit cycle goes on as long as pneumatic eye 528 of the second sewing unit 18 also reveals exhaustion of the cuffs thus, closing valve 549 so that the sewing unit stops after stacking the last cuff at the end of the last partial cycle.

Valve 505, when it is actuated continuously, lets the developing partial cycle end and prevents the beginning of a new one. Valve 501 excluding the loader, switches in the position "excluded" thus preventing the loader from beginning immediately its lifting just after the new cuffs have been placed on it thus causing some difficulties to the loading operation. When this happens, it is advisable, in loading new cuffs, to switch valve 501 manually to the excluded position.

What is claimed is:

1. An automatic sewing unit formed by a loading station, a mounting table, a transfer mechanism, two preparing stations, two sewing stations and a stacking station for the sewn pieces, said transfer mechanism being a mounting member sliding reciprocally forward and backward on a guide driven by a pneumatic motor and whereon are positioned a first group of kinematic members and their relative pneumatic actuators to obtain the lifting and lowering movements from and to the mounting table of a series of pressers provided for the intermittent conveyance of the fabric pieces to be sewn from a station to the following one and a second group of kinematic members and their relative pneumatic actuators to make vertical drawing displacements of the fabric piece from a stack placed in the loading station, progressive movement of the fabric pieces toward the following stations being made by displacement of said mounting member along said guide during its forward feed stroke.

2. The automatic sewing unit according to claim 1, wherein said mounting member is formed by a central bushing and by two side sleeves, onto which said kinematic members are placed with their relative actuators.

3. The automatic sewing unit according to claim 1, wherein said pneumatic motor is formed by two cylinders with pistons strictly connected one to the other, a piston rod of one of said cylinder's piston being fixed at its free end to the mounting table and the free end of piston rod of the second cylinder's piston being connected to a block made out from one of said sleeves forming said mounting member.

4. The automatic sewing unit according to claim 2, wherein said first group of kinematic members is formed by two levers fixed in a lower portion thereof to pins carried by said sleeves and connected at an upper portion thereof to each other by a tie rod, two rods being strictly fixed to a channel to the lower portion thereof, said pressers being elastically connected.

5. The automatic sewing unit according to claim 2, wherein said second group of kinematic members is formed by a rod to which two clamps are fixed for the drawing of fabric pieces, and fixed to a two-arm lever, pivoted in turn to a rod pivoted at one of said sleeves, by a second rod pivoted at one end to the second arm of said lever and at the other end to said sleeve.

6. The automatic sewing unit according to claim 1, wherein each of said preparing stations is provided with two positioning members projecting over the mounting table and displacing the first transversely relative to the direction of the fabric pieces being dragged, and the second displacing longitudinally, these last members being provided with a device for turning over said members under a work plane when transfer of said fabric pieces takes place.

7. The automatic sewing unit according to claim 1, wherein said loading station is formed by a plane provided with two side angle walls suitable to contain fabric pieces to be sewn, and fixed to two walls receiving an intermittent motion by a free-wheel mechanism automatically driven when the height of the fabric pieces stacked on said plane becomes lower than a predetermined value.

8. The automatic sewing unit according to claim 1, wherein said stacking station comprises a first substantially vertical plate which is an extension of a work plane of the unit, a second plate parallel to said first plate, said first and second plates each defining a substantially rectangular opening therethrough, an inclined plane which together with said plates defines a space adapted to receive the sewn piece, a pneumatic cylinder, a third plate attached to said cylinder and slidable through said rectangular opening and a fourth plate, slidably mounted for movement toward and away from said other plates, said fourth plate having its sides longer than the corresponding sides of the third plate, said third and fourth plates holding sewn pieces therebetween.

9. The automatic sewing unit according to claim 1, in which a high-friction belt is provided adapted to cooperate with said pressers' system for the fabric piece conveyance, sliding under the pressers aligned with a work plane edge for all of its length and winding on three idler pulleys carried inside the unit mounting.

* * * * *